United States Patent [19]

Goulds

[11] 4,074,807

[45] Feb. 21, 1978

[54] APPARATUS FOR FEEDING OBJECTS TO A POINT OF USE

[75] Inventor: Anthony John Goulds, London, England

[73] Assignee: Gunson's (Mineral & Automation) Limited, London, England

[21] Appl. No.: 697,246

[22] Filed: June 17, 1976

[30] Foreign Application Priority Data

June 27, 1975 United Kingdom ..... 27295/75

[51] Int. Cl.[2] ..... B07C 9/00; B07C 1/02

[52] U.S. Cl. ..... 209/73; 198/445

[58] Field of Search ..... 209/73; 198/382, 383, 198/396, 445, 446

[56] References Cited

U.S. PATENT DOCUMENTS

| | | | |
|---|---|---|---|
| 2,968,386 | 1/1961 | Zilver | 198/396 X |
| 3,002,617 | 10/1961 | Fraenkel | 198/446 X |
| 3,896,536 | 7/1975 | Keller et al. | 198/382 X |

FOREIGN PATENT DOCUMENTS

| | | | |
|---|---|---|---|
| 1,393,820 | 5/1975 | United Kingdom | 198/446 |

*Primary Examiner*—Robert B. Reeves
*Assistant Examiner*—Joseph J. Rolls
*Attorney, Agent, or Firm*—McGarry & Waters

[57] ABSTRACT

Apparatus for feeding mineral ore or other objects to a point of use comprises a drum having a plurality of parallel, circumferentially extending grooves, and a driven endless belt which contacts or is disposed closely adjacent to the drum and which has a vertically extending and a horizontally extending run upstream and downstream respectively of the drum, objects which have been fed to the said vertically extending run entering the said grooves and being carried onto the said horizontally extending run to form parallel lines of objects thereon which travel towards the point of use.

3 Claims, 3 Drawing Figures

APPARATUS FOR FEEDING OBJECTS TO A POINT OF USE

Figure 1:
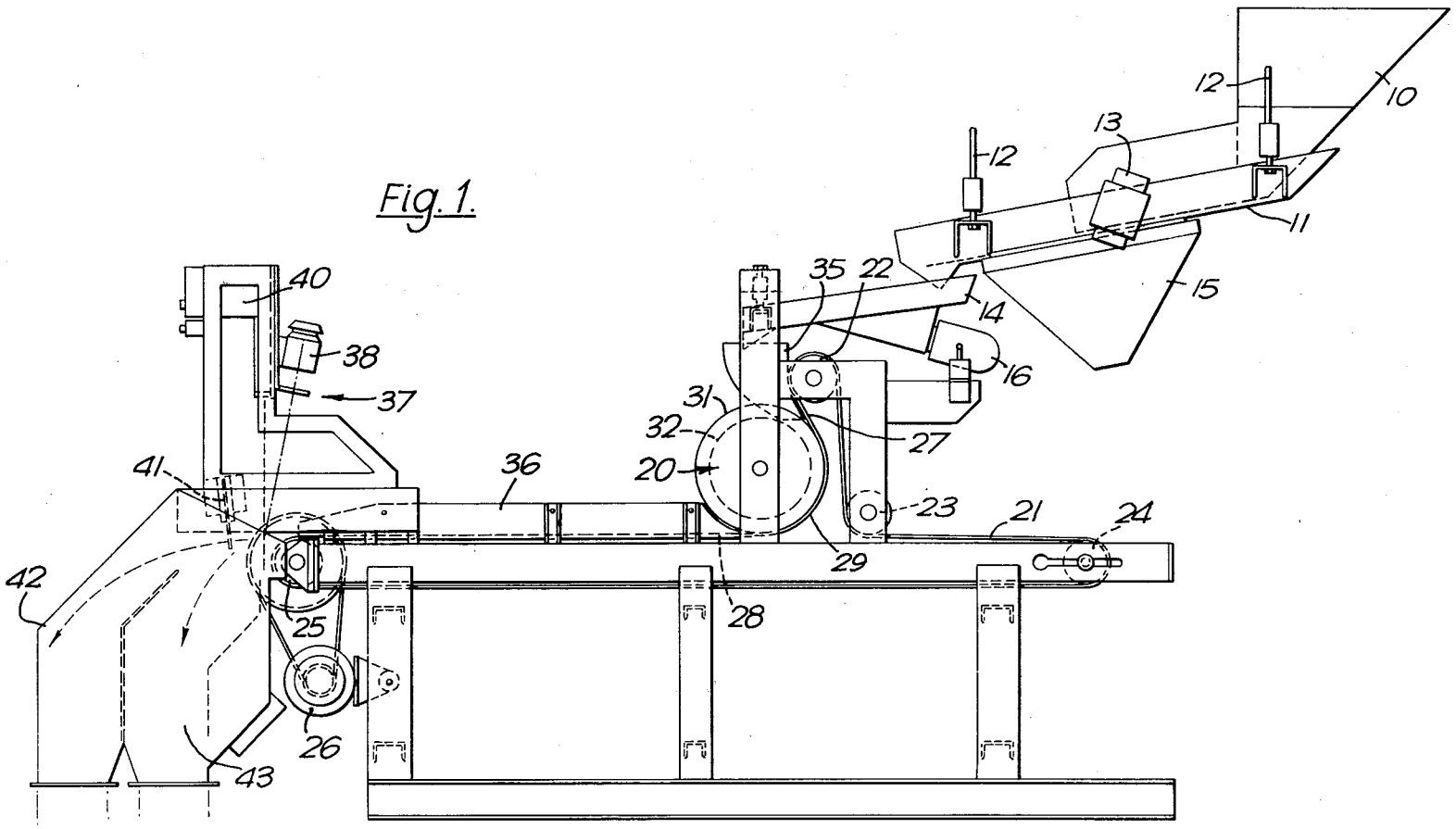

This invention concerns apparatus for feeding objects to a point of use and, although the invention is not so restricted, it is more particularly concerned with apparatus for feeding objects, such for example as pieces of mineral ore, to an inspection and/or ejection area of a sorting machine which sorts the objects into those which have and those which do not have a predetermined characteristic or characteristics.

If objects to be sorted are supplied to the said inspection and/or ejection area by way of an ordinary flat belt, the objects will roll around on the belt and cannot be arranged thereon in the form of a plurality of parallel lines. It is, however, desirable that they should be so arranged since this enables the sorting machine to have a high throughput, permits the ejection apparatus to be sited in the best positions, and reduces the proportion of objects having the said characteristic or characteristics which are unintentionally ejected. Thus, for example, if the objects were positioned on the belt in random locations and there were a number of ejectors for ejecting objects which do not have the said characteristic or characteristics, it would be difficult or impossible to operate the respective ejector only when an object to be ejected was detected, and thus unnecessarily large number of non-ejectable objects would be ejected.

The objects will, moreover, roll around the belt if their speed differs from that of the belt, and there is thus a need for apparatus such that this difference of speed does not occur.

According therefore to the present invention there is provided apparatus for feeding objects to a point of use comprising a drum having a plurality of parallel, circumferentially extending grooves, an endless belt which contacts or is disposed closely adjacent to the drum and which has a vertically extending and a horizontally extending run upstream and downstream respectively of the drum, and means for driving the belt, whereby, in operation, objects which have been fed to the said vertically extending run enter the said grooves and are positioned by centrifugal force onto the said horizontally extending run to form parallel lines of objects thereon which travel towards the point of use.

The term "objects" is used in this specification in a broad sense as including, inter alia, particulate material, including pieces of mineral ore, and agricultural products, such as peas and beans.

The drum is preferably a rotary drum which contacts the belt and is rotated thereby.

The drum may be provided with alternate larger and smaller diameter portions which respectively define the grooves.

The invention also comprises a sorting machine provided with apparatus as set forth above, means being provided for separating the objects leaving the said horizontally extending run into those which have and those which do not a predetermined characteristic or characteristics.

Figure 2:
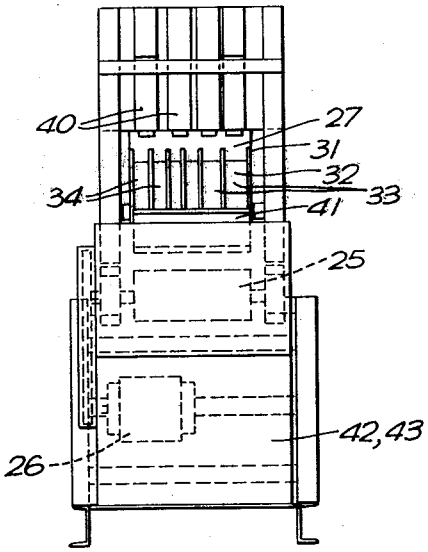
Figure 3:
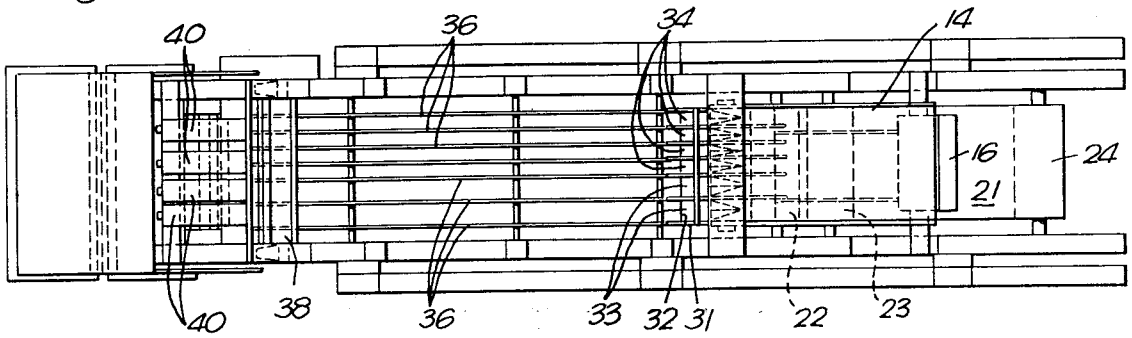

The invention is illustrated, merely by way of example, in the accompanying drawings, in which:

FIG. 1 is an elevation of a sorting machine provided with apparatus according to the present invention, and FIGS. 2 and 3 are respectively a side view and a plan of the machine of FIG. 1.

Referring to the drawings, a sorting machine for sorting pieces of mineral ore and other objects comprises two hoppers 10 (only one shown) for pieces of ore, each hopper 10 being mounted above the upper end of a downwardly inclined tray 11 (only one shown). Each tray 11, which is supported by support members 12, is arranged to be vibrated by a respective electrically operated rotary vibrator 13 so that the pieces of ore pass downwardly over each tray 11 and onto the upper end of a common downwardly inclined field tray 14. Each of the trays 11 is perforated, pieces of ore below a certain predetermined size, and dust, being withdrawn through the chute 15.

The feed tray 14, which is arranged to be vibrated by an electrically operated vibrator 16, is provided with longitudinally extending V-notches (not shown) which divide the feed tray into two adjacent relatively wide channels, which are arranged to receive relatively large pieces of ore from a respective one of the hoppers 10 by way of a respective tray 11, and four adjacent relatively narrow channels, which are arranged to receive relatively small pieces of ore from the other of the hoppers 10 by way of a respective tray 11. Thus the pieces of ore which leave the lower end of the feed tray 14 are aligned in two relatively wide and four relatively narrow longitudinally extending rows.

Mounted below the downstream end of the feed tray 14 is a rotary drum 20 which contacts an endless belt 21 and which is rotated by the latter. The endless belt 21 is entrained over rollers 22, 23, 24, 25, the roller 25 being driven by an electric motor 26.

The endless belt 21 has a vertically extending run 27 and a horizontally extending run 28 which are respectively disposed upstream and downstream of the drum 20.

The drum 20 is provided with alternate larger diameter portions 31 and smaller diameter portions 32 which define between them two relatively wide parallel grooves 33 and four relatively narrow parallel grooves 34 which extend circumferentially of the drum 20 and which are arranged longitudinally of the horizontally extending run 28.

The pieces of ore are arranged to drop vertically under gravity from the downstream end of the feed tray 14 through a chute 35 having funnel shaped portions which guide the pieces of ore from the channels in the feed tray 14 and to the grooves 33, 34. If desired, the distance, from the downstream end of the feed tray 14 to the grooves 33, 34, through which the pieces of ore fall prior to reaching the grooves 33, 34, could be selected so that the vertical speed of the pieces of ore entering the grooves 33, 34 is closely similar to the vertical speed of the vertically extending run 27.

As the pieces of ore are carried circumferentially around the drum 20 they are radially accelerated and subjected to centrifugal force, as at 29, which assists them to settle on the endless belt 21 in stable positions. Thus the pieces of ore, are pressed into the endless belt 21 by reason of the fact that they have been falling vertically and are then caused to change direction as a result of which centrifugal force is generated which forces them into the endless belt 21. This has been found to be a particularly convenient way of forcing the pieces of ore into the endless belt and one which is superior, for example, to employing a resilient roller to effect such forcing since such a resilient roller is very subject to wear and tear.

As the pieces of ore pass through the grooves 33, 34 it is preferable that they touch the endless belt 21 without actually touching the drum 20. As the pieces of ore leave the grooves 33, 34, they form stable parallel lines of pieces of ore on the horizontally extending run 28, these parallel lines of pieces of ore being parallel to the longitudinal sides of the horizontally extending run 28. The maintenance of the said stable parallel lines is also assisted by the provision of guide plates 36 which are mounted immediately above the horizontally extending run 28.

Each of the parallel lines of pieces of ore passes beneath a respective examination apparatus 37, there being an individual examination apparatus 37 for each of the lines of relatively large pieces of ore, and a common examination apparatus 37 for each pair of lines of relatively small pieces of ore. Each examination apparatus 37 comprises a lamp 38 which directs light onto pieces of ore to be examined, and a light sensor and amplifier 40 responsive to light reflected from the said pieces of ore.

Each examination apparatus 37 examines the respective objects to determine whether they have or fail to have a predetermined characteristic or characteristics. For example, each examination apparatus 37 may, as shown, be electro-optical apparatus responsive to the colour of the pieces of ore, or may be X-ray apparatus, or apparatus responsive to the conductivity, resistivity, porosity, magnetism or density of the pieces of ore. As indicated in FIG. 1, each examination apparatus 37 examines the pieces of ore while the latter are in free fall after leaving the downstream end of the horizontally extending run 28, although the pieces of ore could, if desired, be examined while still on the horizontally extending run 28.

Signals from each examination apparatus 37 are passed to a respective comparator (not shown) where these signals are compared with a datum, the comparator controlling operation of a respective pneumatic or other ejector 41 so that when a piece of ore to be ejected is detected by the respective examination apparatus 37 it will be ejected after a suitable time interval by the respective ejector 41. As clearly shown in FIG. 1, pieces of ore which are not ejected fall freely into an "accept" chute 42, whereas those which are ejected are deflected into a "reject" chute 43.

As shown in FIG. 1, the vertically extending run 27 is not truly vertical and may, for example, be disposed at an angle of 10° to the vertical i.e. 80° to the horizontal. Moreover, although the horizontally extending run 28 is shown as being perfectly horizontal, this may be disposed, if desired, at an angle of up to 30° to the horizontal.

Although it is preferred that the pieces of ore do not actually touch the drum 20, it is possible to allow the pieces of ore to fall so that they contact the drum 20 within 90° of the uppermost part of the latter, and are thereafter carried by the drum 20 into contact with the endless belt 21.

The endless belt 21, moreover, instead of contacting the drum 20 may be disposed closely adjacent to the latter, in which case the drum 20 will be separately driven.

I claim:

1. Apparatus for feeding objects to a point of use comprising a drum, means for feeding objects to the drum, an endless belt which is disposed closelyadjacent to and in contact with a portion of the drum, and which has a vertically extending and a horizontally extending run upstream and downstream respectively of the drum, and means for driving the belt and the drum in unison, the drum having a plurality of parallel, circumferentially extending grooves which are arranged longitudinally of the said horizontally extending run and through which the objects may freely pass longitudinally and the objects in the grooves being centrifugally forced against the belt in parallel rows as the belt moves between the vertical and horizontal runs thereof, whereby objects which have been fed to the vertically extending run enter the grooves, are positioned by centrifugal force on the belt in parallel lines of objects which travel towards the point of use.

2. Apparatus as claimed in claim 1 in which the drum is a rotary drum which is rotated by the belt.

3. A sorting machine provided with apparatus as claimed in claim 1, means being provided for separating the objects leaving the said horizontally extending run into those which have and those which fail to have a predetermined characteristic or characteristics.

* * * * *